United States Patent [19]

Lucak

[11] Patent Number: 4,821,479

[45] Date of Patent: Apr. 18, 1989

[54] FINISHING TILE

[76] Inventor: John M. Lucak, 3445 Little St., Redding, Calif. 96003

[21] Appl. No.: 637,262

[22] Filed: Aug. 2, 1984

[51] Int. Cl.[4] ..... E04B 5/04; E04C 2/04

[52] U.S. Cl. ..... 52/603; 52/608; 52/244; D25/138; D25/162

[58] Field of Search ..... 52/603, 388, 608, 392, 52/609, 390, 389, 384, 102, 244, 309.1, 169.9, 169.7, 604, 596; 4/584, 506; D25/138, 140, 157, 162

[56] References Cited

U.S. PATENT DOCUMENTS

| | | | |
|---|---|---|---|
| D. 171,470 | 7/1951 | Toohey | D25/80 |
| D. 212,749 | 11/1968 | Wheeler | D25/80 |
| D. 212,944 | 12/1968 | Wheeler | D25/94 X |
| D. 214,893 | 8/1969 | Wheeler | D25/95 |
| D. 218,031 | 7/1970 | Wheeler | D25/95 |
| 706,874 | 8/1902 | Alcan | 52/388 X |
| 782,447 | 3/1904 | Hazlehurst | D25/80 X |
| 1,694,665 | 12/1928 | Parker | 52/603 X |
| 2,246,898 | 6/1941 | Sayre | 52/309.1 X |
| 2,328,731 | 9/1943 | Lovely | 52/244 X |
| 3,064,273 | 11/1962 | Kwake | 4/506 X |
| 3,319,392 | 5/1967 | Fitzgerald | 52/389 |
| 3,467,738 | 9/1969 | Pyzel | 264/30 |
| 3,621,627 | 11/1971 | Kramer | 52/608 |
| 3,975,782 | 8/1976 | Lankheet | 52/169.7 |
| 4,231,201 | 11/1980 | Harnois | 52/169.6 |

FOREIGN PATENT DOCUMENTS

| | | | |
|---|---|---|---|
| 629092 | 3/1963 | France | 52/608 |

*Primary Examiner*—John M. Jillions
*Attorney, Agent, or Firm*—Lothrop & West

[57] ABSTRACT

A finishing tile approximately wedge-shaped in plan has upper and lower, planar surfaces and side edge surfaces extending radially with respect to a center and has inner and outer edge surfaces arcuate about the same center. The side edge surfaces have projecting and radially spaced positioning lugs. Preferably, the inner tile edge is down-turned beyond the lower tile surface.

1 Claim, 1 Drawing Sheet

FINISHING TILE

BRIEF SUMMARY OF THE INVENTION

A finishing tile used along a margin curved about a center has upper and lower planar, parallel surfaces, an outer edge surface and an inner edge surface both of which are substantially arcuate about the center and a pair of side edge surfaces meeting the outer and inner edge surfaces and disposed substantially radially with respect to the center. The arcuate inner edge suface is also downturned away from the upper surface and defines a surface of compound curvature. There are interengaging lugs on the side edge surfaces circumferentially to space and radially to locate one of the tiles with respect ot an adjacent, like tile.

PRIOR ART

Reference is made to the following U.S. Pat. Des. Nos.:

171,470, Toohey,
212,749, Wheeler, Jr.,
212,944, Wheeler, Jr.,
214,893, Wheeler, Jr.,
218,031, Wheeler, Jr., and
U.S. Pat. No. 782,447, Hazelhurst While all of the foregoing relate to finishing tile, none of them corresponds with the finishing tile as described and claimed herein.

DETAILED DESCRIPTION

Figure 1:
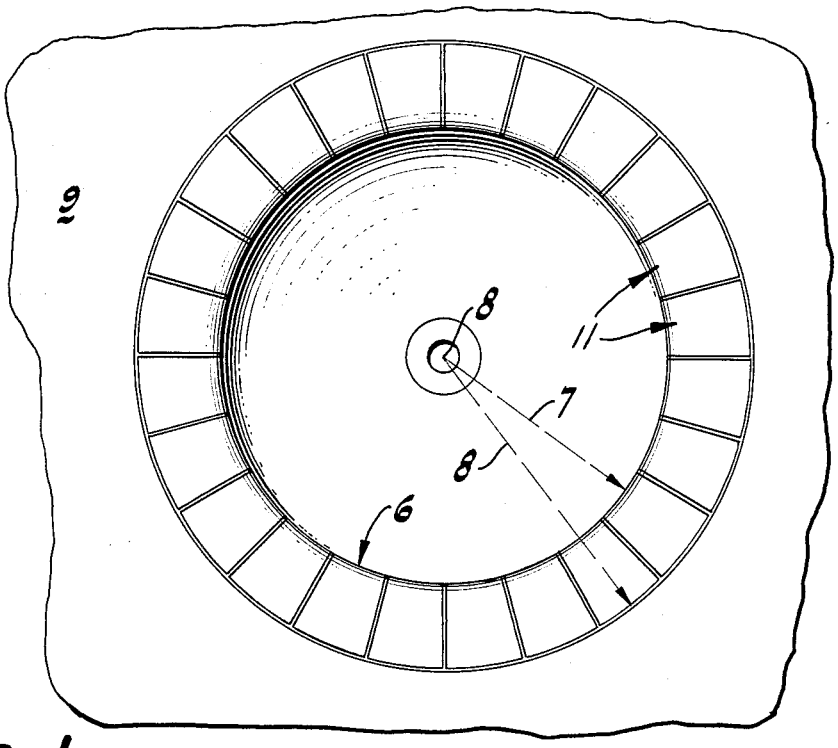
FIG. 1 is a plan, portions broken away, of a typical finishing tile installation around a circular basin with grout installed.

The finishing tile of the invention is susceptible to installation and use in several forms and in numerous different environments. It is particularly designed and adapted for use in connection with a finished construction surrounding a circular opening 6 such as defining the rim of a basin or bowl. While the term "circular" is utilized herein, there are comparable installations with curves not exactly mathematically circular but of approximately circular configuration such as ellipses and ovals.

The circular contour 6 is arcuate on a radius 7 about a center 8 or axis and while dimensions are not critical it may be considered that the radius 7 is of the order of six to eight inches. The contour or margin 6 is conveniently defined in a surround 9 of any suitable supporting construction and finish, either to match or to contrast with the rest of the installation.

Pursuant to the invention there is installed in or on the surround 9 and along the margin or rim of the contour 6 a plurality of substantially identical finishing tile 11. Each of the tiles 11 is conveniently an integral body having a generally planar upper surface 12 and a generally planar, parallel lower surface 13. The body is also defined by a pair of wedge defining or converging side edge surfaces or planes 14 and 16, each lying along one of two radii 17 and 18 or radial planes struck from the center 8 or axis.

There is likewise an inner edge surface 19 that is arcuate or curved on the curvature of the contour 6 with a radius 21 comparable to the radius 7 while the outer edge surface 22 of the tile is likewise curved or arcuate at a radius 23 also struck about the center 8 or axis.

Figure 6:
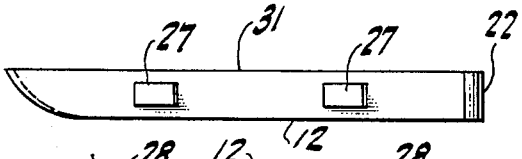
FIG. 6 is a side elevation, like FIG. 4, showing the opposite side edge surface of the modified tile of FIG. 5, in inverted position.
Figure 5:
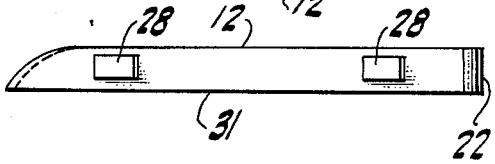
FIG. 5 is a side elevation, like FIG. 3, and showing one side edge surface of a modified form of tile.

The shapes of the tile may vary in side elevation between a relatively flat construction, as shown in FIGS. 5 and 6. Usually there is a down-turned inner rim 24. This is preferably uniformly curved in a vertical plane (FIG. 3) and likewise partakes of the curvature of the radius 23 about the center 8 so that the rim or edge 24 has a compound, relatively stiff and self-reinforcing curvature. The rim 24 at its lower portion ends in a flat surface 26 parallel to the surfaces 12 and 13 and merges neatly with the surround 9 or support.

Figure 2:
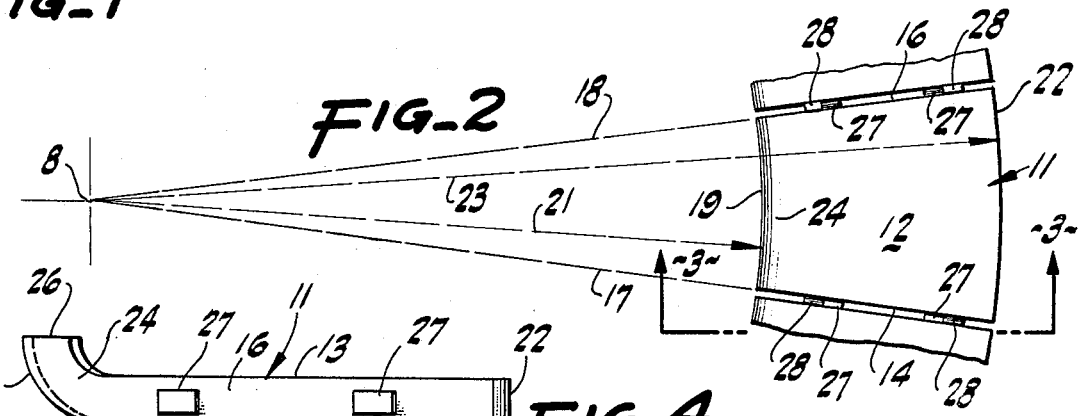
FIG. 2 is an enlarged plan of adjacent tile, as in FIG. 1, before grouting.
Figure 4:
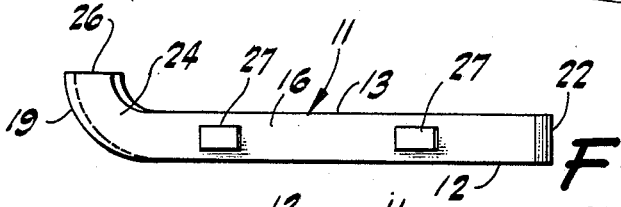
FIG. 4 is a side elevation, like FIG. 3, but showing the opposite side edge surface of a tile in inverted position.

The side edge surfaces 14 and 16 are similar to each other in that each has projecting from it a pair of lugs 27 on one edge spaced relatively close together in a radial direction and lugs 28 on the other edge spaced relatively far apart when measured in a radial direction. The spacing is such that when two identical tiles are placed alongside each other, as shown in FIGS. 1 and 2, the various lugs 27 and 28 at their ends terminate in planes radial to the center 8 and so abut adjacent radial side edge surfaces of the adjacent tile. This establishes transverse spacing between them to allow for grout. The lugs 27 and 28 also interlock in a radial direction so as to fix the relative radial positions of the adjacent tile.

To provide this arrangement, the contour 6 or basin edge, for example, is provided with or defined by a support structure 29 receptive to the application of a plurality of the indicated tile 11. The first tile is leveled and positioned accurately with its inner edge surface 19 coinciding with the curvature of the contour 6 and with its side edge surfaces 14 and 16 carefully aligned on radii or in radial, vertical planes emanating from the center 8.

The next adjacent, similar tile along one side edge surface is readily positioned since the lugs 27 and 28 interengage to establish a set circumferential or peripheral position as well as a proper radial position. Successive tile are positioned in the same fashion repeating the technique and setting each of the tile on or in the supporting structure 7. The arcuate extent of each tile is such for a given diameter contour 6 that an integral number of tile, when positioned, result in a continuous band or annular trim with the lugs 27 and 28 touching. The intervening gaps are preferably grouted. The remaining part of the support 29 and surround 9 can be finished in any desired fashion.

Figure 3:
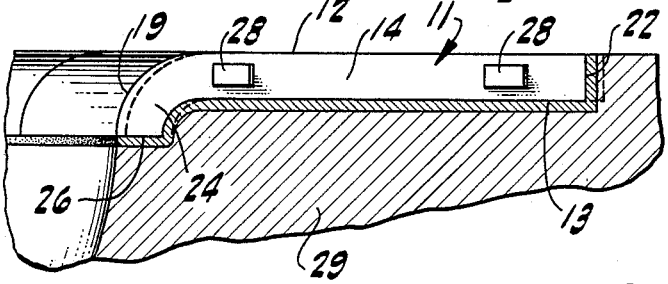
FIG. 3 is a side elevation, indicated by the line 3—3 of FIG. 2, showing one side edge surface of a tile in erect position.

While tile as shown in FIGS. 2 and 3 are ordinarily preferred, especially for the stiffness in a vertical direction provided by the rim at the inner edge, there are instances wherein such edge stiffness is not important. In those cases, tile such as shown in FIGS. 5 and 6 are suitable. These correspond with the tile previously described except they are not stiffened or reinforced by a down-turned inner edge rim but have an entirely planar lower surface 31.

By the use of the tile as described and shown, there is afforded easily and accurately an appropriate trim immediately around a contour 6 such as the margin of a bowl, without cutting or nipping or shaping any individual tile. The tile are simply assembled and seated on or in the support structure 29. The job is finished by placing grout between the adjacent tile and around the lugs 27 and 28 so that a firm, neat, attractive job is readily and economically accomplished without special shaping of any tile.

I claim:

1. A finishing tile especially for use with identical adjacent tile in a planar area around a substantially circular opening having a center axis comprising a discrete body having substantially parallel, planar upper and lower surfaces, a pair of side edge surfaces, a smooth inner edge surface substantially arcuate about said center axis, a smooth outer edge surface substantially arcuate about said center axis, said side edge surfaces meeting said inner and outer edge surfaces and lying in different radial planes that contain said center axis, a first pair of lugs both extending the same predetermined lateral distance from one of said side edge surfaces and each of said first pair of lugs having a first planar face extending perpendicular to said one of said side edge surfaces parallel to and facing toward the other first planar face a predetermined radial distance therefrom, and a second pair of lugs both extending said same predetermined lateral distance from the other one of said side edge surfaces and each of said second pair of lugs having a second planar face extending perpendicular to the other one of said side edge surfaces parallel to and facing away from the other second planar face substantially said predetermined radial distance therefrom and in position to abut one of the first planar faces of an adajcent identical tile.

* * * * *